United States Patent [19]

Pulciano et al.

[11] Patent Number: 4,620,434

[45] Date of Patent: Nov. 4, 1986

[54] DOMER ASSEMBLY FOR CONTAINER-FORMING APPARATUS

[75] Inventors: Sam C. Pulciano, Norridge; Raymond Mikas, Chicago; Robert M. Wyleta, Burbank, all of Ill.

[73] Assignee: National Can Corporation, Chicago, Ill.

[21] Appl. No.: 657,224

[22] Filed: Oct. 3, 1984

Related U.S. Application Data

[63] Continuation-in-part of Ser. No. 426,888, Sep. 29, 1982.

[51] Int. Cl.[4] ..... B21D 22/00

[52] U.S. Cl. ..... 72/347; 72/349

[58] Field of Search ..... 72/347–349

[56] References Cited

U.S. PATENT DOCUMENTS

| | | | |
|---|---|---|---|
| 3,771,345 | 11/1973 | Paramonoff | 72/349 |
| 4,289,014 | 9/1981 | Maedi | 72/347 |
| 4,372,143 | 2/1983 | Elert | 72/349 |

*Primary Examiner*—Leon Gilden

*Attorney, Agent, or Firm*—Robert A. Stenzel; Ralph R. Rath

[57] ABSTRACT

Apparatus for reforming an end wall of a container shell including a punch reciprocable along a path on a frame and a domer assembly at the end of the path. The domer assembly includes a domer pad and an annular forming element with biasing means between the pad, the annular forming element and the base. The biasing means for the annular forming element includes an annular chamber divided into spaced segments that each have a piston reciprocated therein and a pressurized fluid source connected thereto, while the domer pad is supported on a post that extends through a tubular column forming part of the base and has an enlarged pad at the opposite end which also is in communication with the pressurized fluid source to produce an end wall configuration that has a large outer annular arcuate portion merging with an annular flat support portion that has an upwardly-extending flat annular portion surrounding a central upward dome.

11 Claims, 3 Drawing Figures

DOMER ASSEMBLY FOR CONTAINER-FORMING APPARATUS

REFERENCE TO RELATED APPLICATION

This application is a continuation-in-part application of U.S. Ser. No. 426,888, filed Sept. 29, 1982, incorporated herein by reference.

TECHNICAL FIELD

The present invention relates generally to the formation of drawn and ironed containers having a cylindrical shell and an integral end wall and, more particularly, to a forming apparatus for the reforming of the end wall of a drawn and ironed container.

BACKGROUND PRIOR ART

It is well known to form containers or cans, and particularly beer or beverage cans, by a drawing and ironing process wherein flat sheet metal stock material is fed from a coil to a press and circular blanks are die-cut from the stock material and formed into cups. The shallow cups have side and bottom walls that are substantially equal in thickness and these cups are then transferred to a body-making apparatus where the cups may be redrawn to further reduce their diameter and increase the height to produce a finished container shell.

Usually, the bodymaker consists of a punch or mandrel that receives the shallow cup and has an external diameter substantially equal to the final internal diameter of the container shell. The mandrel or punch is moved along a path and initially forces the cups through a redrawn ring and then through a plurality of ironing dies or rings which have inside diameters that are consecutively smaller than the outside diameter of the redrawn cup passing therethrough so that pressure between the ironing dies and the punch progressively reduces the thickness of the side wall and forces the metal along the punch to increase the overall height of the container body. After the side wall of the container has been reduced to a minimum thickness, the end wall, which remains substantially equal to the original thickness of the sheet metal stock, is reformed generally into an overall dome-shaped configuration.

In most commercial presses, the bodymaker or drawing and ironing machine includes a domer assembly that is positioned at the end of the stroke of the punch or ram to cooperate with the punch and reform the end wall at the end of the drawing and ironing operation.

One type of machine that has been utilized for producing container shells of the above type is manufactured by Ragsdale, Inc., and is identified as a Model CR-24 Can Wall Drawing and Ironing Press. This machine includes a plurality of axially-spaced die assemblies that cooperate with the movable punch to convert the shell cup into a finished container shell. At the end of the stroke, the punch cooperates with the domer assembly for producing the final configuration of the integral end wall of the container. Usually such end wall configuration is domed inwardly, as for example is shown in U.S. Pat. No. 3,942,673, which is assigned to the Assignee of the present invention. This dome configuration for the end wall has a very critical configuration which allows the container to withstand substantial internal pressures during the filling and handling operations, and also to withstand considerable stresses or resistance to buckling and inversion when the container is dropped after being filled.

Another type of machine that has found a remarkable degree of commercial success for producing container shells of the above type is manufactured by Standun, Inc. and is generally disclosed in U.S. Pat. No. 3,735,629. The Standun machinery, in its present commercial form, as modified by the Assignee of the present invention, has been proven to be capable of producing container shells at a rate of more than 200 per minute under strenuous operating conditions and, thus, the time for reforming the end wall to its final complicated configuration is extremely limited and the container end wall must be free of any wrinkles after such reforming process.

In the commercial machinery discussed above, the redraw and ironing rings, as well as the stripper assembly, are usually formed into a package, such as disclosed in U.S. Pat. No. 4,300,375, that fits into a very confined space. Likewise, the domer assembly must fit into a confined space to conserve space for the overall unit.

To produce the final dome configuration of the end wall, various types of doming assemblies have been proposed for cooperating with a punch to reform an end wall of a container shell.

One example of such doming assembly is disclosed in U.S. Pat. No. 3,491,574 wherein a fixed doming element is positioned in the path of movement of the punch adjacent the end of its stroke and has a surrounding stripping element for removing the finished shell from the punch after the doming operation has been completed. One of the problems of having a fixed domer element for reforming the end wall of a container shell is that difficulties may be encountered when a cup is initially misfed into the punch, which can cause serious damage to the domer assembly, as well as to the remaining elements of the press or machine. Furthermore, wrinkling may occur during the reforming of the end wall if the pressures are produced unevenly between the domer assembly and the punch.

In an effort to overcome some of these problems, U.S. Pat. No. 3,771,345 discloses a domer assembly in which the domer pad or element is capable of retracting somewhat against a pneumatic pressure source to absorb the shock at the end of the stroke of the punch. Also, the more complicated configurations for the domed end wall, particularly end walls having a peripheral annular portion surrounding the reduced central domed portion of a container, requires separate elements in the domer assembly for producing the final end wall configuration. U.S. Pat. No. 3,771,345 discloses a domer assembly, which is commonly referred to as a double action domer, wherein an annular forming element surrounds the central domer pad to produce the inwardly-directed configuration of the lower peripheral end of the side wall of the container and then an upwardly reversed dome interconnected to the annular portion by a generally vertical wall.

In an effort to reduce the cost of finished containers, manufacturers are constantly striving to reduce the thickness of the initial stock material, thereby decreasing the overall metal cost of each container. Since the end wall (bottom) of the container essentially represents the initial thickness of the can stock, new bottom profiles are required to maintain the pressure performance of thinner guage of stock materials. Purchasers and users of such containers, particularly the beer and beverage industry, have very stringent requirements which require that the finished and filled container be capable of maintaining internal pressures above 100 psi minimum without any significant distortion, and to provide such capability, rather elaborate dome or end configurations have been developed. Another more recent requirement for such drawn and ironed containers is that the container must have a minimum resistance to the reversal of the end wall when the container is inadvertently dropped after it has been filled and is ready for sale and that the end wall have a buckle resistance of more than 100 psi.

Thus, one of the more recent proposals for the end wall configuration of the container consists of forming an arcuate annular portion depending from the end wall to a small flattened portion which defines the lower end of the container and then into an upwardly-directed annular portion which ends in a central upwardly-directed dome. This type of end wall configuration is disclosed in the above U.S. Ser. No. 426,888, and the container incorporating such end has received a remarkable degree of commercial acceptance.

However, as the thickness of the stock material decreases, the problem of wrinkling the container shell wall becomes more acute, particularly when attempting to produce the more elaborate configurations in the end wall.

In order to produce the more elaborate configuration of end wall of container shells with thinner metal, such as discussed above, more elaborate equipment is necessary to prevent wrinkling of the metal during the reforming process. Thus, the above-mentioned U.S. Pat. No. 3,771,345, which discloses a center domer element surrounded by an annular element, has both elements maintained in a predetermined position through a pair of piston and cylinder arrangements wherein air is introduced to apply the desired forces to the container shell in cooperation with the punch to reform the end wall. Another example of a domer assembly which has previously been used is disclosed in U.S. Pat. No. 3,730,383, wherein a fixed domer element is surrounded by a movable annular element that is biased through an air cylinder, and U.S. Pat. No. 4,289,014 where air bags are used for shock absorption for both the center domer pad and the annular forming element.

In addition to the above, other types of biasing mechanisms, such as spring-biasing mechanisms, have been proposed for a center domer element and the annular domer element, such as disclosed in U.S. Pat. No. 3,967,482. However, the forces applied in utilizing the spring assembly concept do not lend itself to uniform and equal application of forces around the entire perimeter of the container during the reformation of the end wall, which may result in wrinkles, making the container unuseable.

Thus, while numerous types of domer assemblies have been proposed and have been utilized on a commercial basis, manufacturers of drawn and ironed containers are constantly striving the enhance the machinery for forming such drawn and ironed containers so that it will be more reliable, can easily be maintained and can also be changed to change the configurations of the container end walls, if desired.

SUMMARY OF THE INVENTION

According to the present invention, a unique domer assembly has been developed which is capable of producing substantially wrinkle-free reformed end walls in drawn and ironed containers using minimum thickness of stock material that has heretofore not been possible. The domer assembly, in cooperation with a conventional punch of a drawing and ironing machine, is designed such that the forming elements can easily be removed and replaced without disassembly of the entire unit.

More specifically, the domer assembly of the present invention is designed for use with an ironing machine having a punch reciprocable along a path on the frame of the ironing machine which cooperates with the domer to reform the end wall of a container shell. The punch cooperates with a center domer element and an annular forming element which are resiliently biased to a first position and are movable from said first position in response to forces applied by the movement of the punch to absorb the shock loads developed during the can manufacturing operation and also to insure that there is uniform conformity of the end wall of the container shell with the domer and the punch without any wrinkles.

In the embodiment disclosed, the center domer element is mounted on a post that extends through a tubular column which forms part of the base or frame and the post has an enlarged pad or surface on the opposite end thereof that is located within a sealed chamber defined in the base or frame. The sealed chamber is adapted to receive pressurized pneumatic fluid, such as air, to act as a shock-absorbing member, as will be described later.

The doming element is likewise biased to a first position through a pneumatic pressurized fluid source that cooperates with a pair of axially-spaced annular pistons which surround the tubular column and have adjacent ends in engagement with each other, while one end of one piston is engageable with the annular forming element, preferably through a plurality of circumferentially-spaced pins. More specifically, the biasing means comprise first and second axially-spaced annular pistons that are located in separate chambers with the second piston having an annular flange surrounding the support column that has a free end which is engageable with the first piston so that the two pistons move as a unit and are separately enclosed in sealed chambers. Thus, large forces can be developed in a very confined space.

Furthermore, the structural arrangement of the supporting elements for the dome pad and the annular-forming or doming element are at all times exposed for easy access and are held in the assembled position through an annular collar, which can readily be removed so that the components can be replaced in a minimum period of time, reducing the downtime for the machinery in the event such is necessary.

The particular configuration of the domer elements and the punch, along with biasing means that result in large holding pressures on the container end wall during the reforming process, allows the end wall of a container formed from stock material of 0.0130 inches or less into a configuration that is capable of resisting buckling pressure greater than 100 psi. The end wall is free of any wrinkles and is formed to the rigid configuration that is capable of resisting dome reversal when filled with a product and inadvertently dropped.

DETAILED DESCRIPTION

Figure 1:
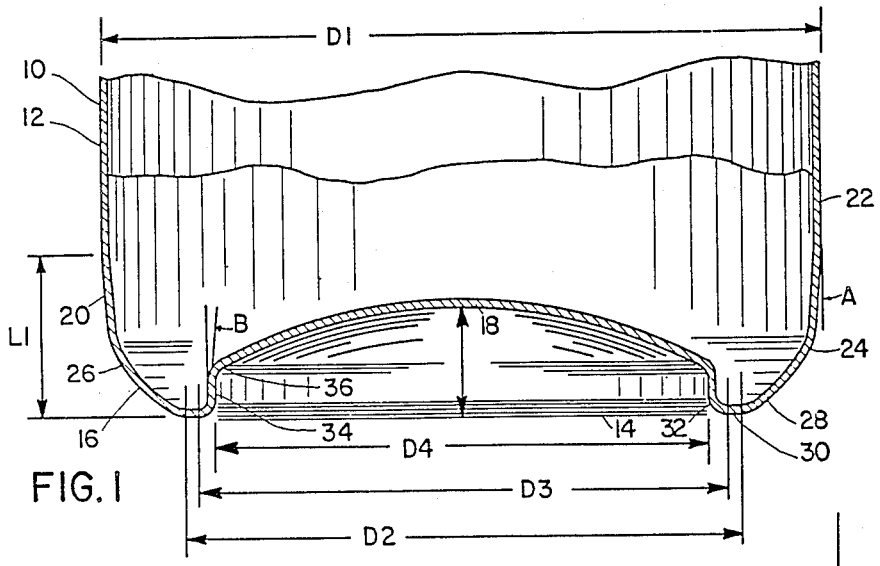
FIG. 1 is a fragmentary cross-sectional view of the lower portion of the container having the present invention incorporated therein.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

FIG. 1 of the drawings discloses the bottom portion of a container shell, generally designated by reference numeral 10, having a generally cylindrical side wall 12 and an end wall 14. Container 10 is what is commonly known as a drawn and ironed container shell wherein a flat circular metal disc is converted into a shallow cup in a press, commonly referred to as a cupper. The shallow cup is then delivered to a drawing and ironing machine, commonly referred to as a bodymaker, wherein the cup is reformed to reduce the diameter thereof and increase the height thereof and then reduce the thickness of the side wall. The end wall is subsequently reformed at the end of the stroke between the punch and related domer element in the bodymaker.

As indicated above, one of the areas that requires design attention in reducing the metal thickness of the starting material, while maintaining the same "cut edge" diameter for the finished container, is the specific configuration of the end wall or bottom 14.

In designing drawn and ironed containers, particularly for beer and beverages, critical design criteria that must be maintained are buckle pressures on the order of 100 psi and crush or column strength on the order of 400 pounds, as well as resistance to internal pressures greater than 100 psi.

It is a known fact that reducing the overall diameter of the lower edge of the end wall of a drawn and ironed container will result in increased buckle pressures for the subsequently-filled container. However, reducing the diameter of the end wall of a domed container can result in also reducing the column strength of the container, as well as the stability of the container.

Buckling or inversion of the end wall of the container can either result from inversion of the domed configuration beginning at the center of the end wall or an outward flexing of the peripheral portion of the dome allowing the entire dome to "pop" out. If the dome for the container is too shallow, the weakest area of the container end wall is the center of the dome, which will tend to invert and progressively increase until the entire dome portion bulges outwardly. On the other hand, if the perimeter of the dome is not sufficiently rigid, an outward flexing may occur which will allow the entire end wall or domed portion of the end wall to invert or collapse.

According to the present invention, a seamless drawn and ironed container is formed from a stock material of reduced thickness, for example 0.34 mm (0.0134 inches) thick aluminum stock, and the finished container has the ability to withstand internal pressures on the order of 110 psi and also has a column strength of approximately 400 pounds or greater. Moreover, the container of the present invention exhibits low container growth and excellent results in drop tests, typically having no failures in the initial 3 or 4 vertical drops and a pass rate as high at 96% after 10 vertical drops. The unique container incorporates a domed end wall that is of a configuration which is simple to produce on a mass production scale and produces the improved characteristics even with thinner gauge metal.

Figure 2:
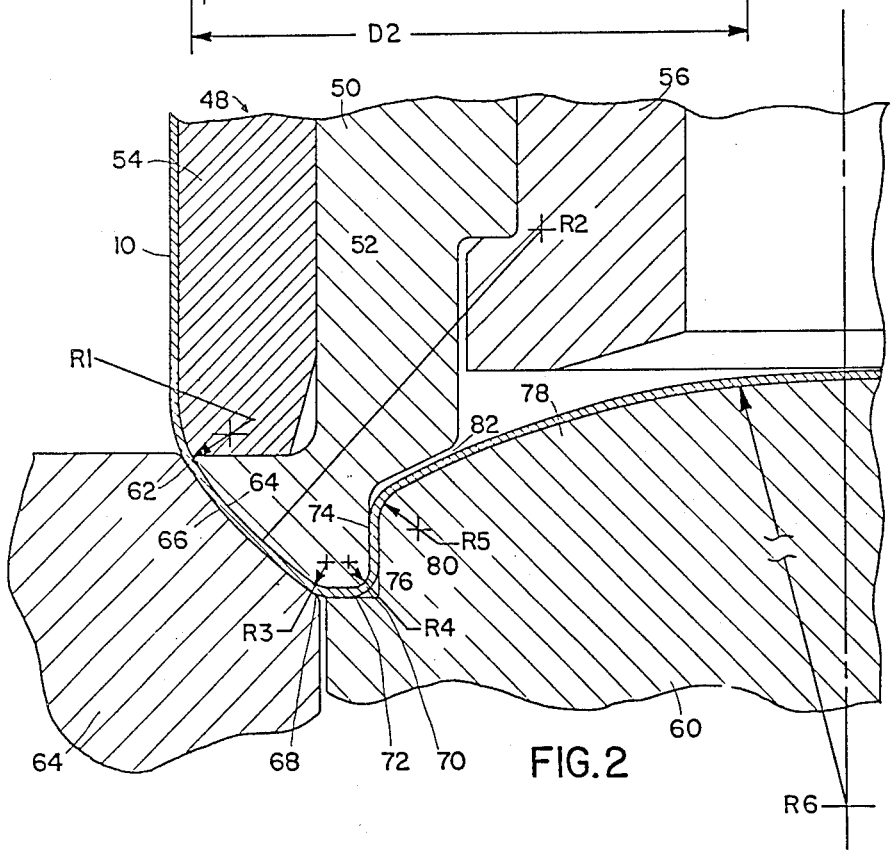
FIG. 2 is an enlarged fragmentary section view showing a portion of the lower end of the container illustrated in FIG. 1 and also showing the tooling utilized for reforming the end wall; and, FIG. 3 is cross-sectional views of a fragmentary portion of a domer assembly and punch that forms part of a drawing and ironing machine.

Referring to FIGS. 1 and 2 of the drawings, the area 16 between the side wall 12 and the domed portion 18 of the end wall 14 includes a first annular inwardly-directed portion 20 which may be utilized to provide a thickness transition from the thicker end wall 14 to the thinner ironed side wall 12. Preferably, portion 20 is flat and inwardly inclined by a small angle A and has its upper edge 22 located a substantial distance above the center of the domed portion 18. Cylindrical side wall 12 has a diameter identified by reference D1. A first arcuate annular radiused portion 24 is located at the lower end of the first annular portion 20 joining annular portion 20 to a second arcuate annular portion 26. The second arcuate annular portion 26 is directed inwardly and has a third annular arcuate radiused portion 28 at the lower end thereof, which joins portion 26 to a flat annular lower support portion 30 at the lower end thereof. The outer edge of the flat annular portion 30 defines the base diameter D2 for the container and the periphery of end wall 14 while the inner edge of lower flat annular portion 30 has a diameter D3. Flat lower portion 30 is joined by a fourth annular arcute radiused portion 32 with an upwardly-directed flat annular portion 34. On the upper end of upwardly-extending portion 34 is a fifth arcuate annular radiused portion 36 which joins portion 34 with domed portion 18.

The first annular arcuate portion 24 has a radius R1, while the second arcuate annular portion 26 has a radius R2 and arcuate portions 28 and 32 have radii R3 and R4 respectively. The flat annular flat lower portion 30 is joined to the domed center portion 18 through the annular arcuate portion 36, having a radius R5, while the center upwardly convex dome 18 has a radius R6. The juncture 22 between flat annular wall portion 20 and cylindrical side wall 12 is spaced by a dimension L1 above the lower surface of support portion 30, while the center of dome 18 is spaced by a dimension L2 above support portion 30 and L1 is greater than L2.

The particular dimensions and radii for the container of the present invention have a critical relationship which produce a container having excellent axial strength (column strength), resistance to buckling due to internal pressure and resistance to buckling due to dropping or other such harsh handling. Moreover, the superior design of the end wall of the present invention allows containers to be formed from thinner gauge metal stock, such as 0.0130 inches aluminum, or thinner, while maintaining excellent structural qualities.

As an example of dimensions and radii which are advantageous for the container configuration of the present invention, it has been determined that having the annular arcuate portion 26 with a radius which is on the order of 40%–45% of the radius of the domed portion 18 will result in increased strength characteristics for the container. The radius (R6) of the dome 18 is less than the diameter (D1) of the container and is greater than the support diameter (D2), while the small acuate angle A is preferably less than 5°. Also, the radius R1 for the first annular arcuate portion 24 is more than 10 times the thickness of the dome 18, preferably 4.76 mm or 14 times the thickness of dome 18. The radii R3 and R4 for third arcuate portion 28 and fourth arcuate portion 32 are less than radius R1 and preferably at least 0.89 mm. The radius R5 for annular arcuate portion 36 is greater than radius R3 and R4. Radius R2 for annular tapered portion 26 is preferably in the range of about 17.80 mm to about 25.40 mm.

The specific relation of the various radii will allow a cup to be redrawn without producing wrinkles and also will allow a sufficient amount of metal to be drawn from the side wall into the end wall during the doming operation, again without producing wrinkles in the area 16. This results in using some of the metal in the side wall for forming the end wall, which will reduce the wall thickness of the side wall proportionately.

Of particular importance in providing the superior performance of the end wall of the present invention is the utilization of a flat lower support portion 30, relatively vertical upwardly-extending flat portion 34, and a relatively small diameter (D4) dome portion 18. The width of flat lower support portion 30 ($\frac{1}{2}$ times (D2/D3)) is preferably approximately 0.51 mm to 1.27 mm (0.020 inches to 0.050 inches). Flat portion 30, while providing an area upon which container 10 may sit, more importantly also provides increased buckling resistance. If portion 30 is not flat, but rather formed as a radiused section, such as the container of said aforementioned U.S. Ser. No. 280,448, it is more easily "unfolded" (i.e. a spreading apart between portions 26 and 36) in response to internal container pressure. The relatively reduced dome diameter D4 of the present invention, approximately 50.65 mm (1.994 inches) for the container of U.S. Ser. No. 280,448 increases dome buckling resistance because there is less area upon which the internal container pressure may push outwardly against. Dome diameter D4, while reduced, is still large enough that a stable resisting area 30 can be provided adjacent to dome 18. Also, dome 18 is not so small as to present manufacturing problems during the redraw operation. Also of particular importance is that upwardly-extending flat portion 34 is nearly vertical, such that it forms an angle B with respect to a vertical plane extending through the center of radius R4 wherein angle B is approximately 10° or less, preferably approximately 5°. With angle B within this range, the forces acting downwardly against dome 18 are less likely to cause a buckling of the end wall than if some greater angle B was utilized.

A specific example of a container that was manufactured from a stock material having a thickness of 0.0134 inches utilizing a flat disc having a "cut edge" diameter of 138.68 mm (5.460 inches) was produced by first converting the disc into a cup and subsequently converting the cup into a finished drawn and ironed container having a diameter (D1) of 65.96 mm (2.597 inches). The juncture 22 between cylindrical side wall 12 and flat annular portion 20 was positioned 12.70 mm (0.500 inches) above the bottom surface of lower flat portion 30 and was tapered inwardly to produce an angle A of approximately 2°. The first annular arcuate portion 24 had a radius R1 of 5.08 mm (0.200 inches), while the inwardly-tapered arcuate portion 26 had a radius R2 of 20.32 mm (0.800 inches). Radii R3 and R4 were 1.02 mm (0.040 inches) and radius R5 was 1.57 mm (0.062 inches). The container had a base diameter D2 of approximately 50.8 mm (2.000 inches), while the upper end of the flat annular portion 34 had a dome portion diameter D4 of 45.72 mm (1.800 inches). The length of the flat portion 30 was approximately 0.35 inches.

Actual comparison tests were made between the container construction with the characteristics set forth above and compared with containers of the type disclosed in U.S. Pat. No. 3,730,383, with an arcuate tapered annular wall, and it was determined that the subject container has significantly greater resistance to buckling, as well as crushing.

Furthermore, with the unique relationship of the various dimensions, no sharp radii need be produced in the finished container, such as, for example is required in the container disclosed in U.S. Pat. No. 3,730,383, which requires a separate doming operation after producing the drawn and ironed container shell.

Another significant advantage is the fact that there is no required reversal of metal during the reforming process, as is necessary in the container disclosed in U.S. Pat. Nos. 3,690,507 and 4,151,927.

Moreover, the container of the present invention formed from 0.0134 inches thick aluminum stock provided axial strength and resistance to buckling due to internal pressure, which was about the same or better than that exhibited by a container produced from 0.0145 inches thick aluminum stock and in accordance with U.S. Ser. No. 280,448. Also, the container of the present invention exhibited far better drop test results than the container of U.S. Ser. No. 280,448. For example, containers produced in accordance with U.S. Ser. No. 280,448 and of a 0.0134 inches aluminum stock could be expected to have more than 30% dome reversals after one drop, with over 80% of the containers having dome reversals after two drops, and nearly 100% having dome reversal after just five drops. By comparison, as stated previously, the container of the present invention, formed of 0.0134 inches aluminum stock typically has no reverals after the first three or four drops, and typically less than 10% after ten drops.

The punch and domer utilized for producing the new container is disclosed in FIG. 2. The punch 48 preferably is a two-piece punch having a nose 50 with outer cylindrical surface 52 about which is mounted generally cylindrical-shaped punch sleeve 54. Punch 48 is axially advanced and retracted by punch retainer 56, to which punch nose 50 is secured. Cooperating with punch 48 in forming the container end wall is domer element 60 and annular forming element 64.

In operation, a drawn and ironed container body 10 is formed over punch 48 with punch 48 then continuing in its stroke until it is forced against domer 60 and annular forming element 64 to reform the container end wall. A blending profile 62 at the bottom of punch sleeve 54 acts to form arcuate portion 24 of container 10 with a radius of R1 and side wall angle A. An outer lower radiused surface 64 of punch nose 50 cooperates with a cooperating surface 66 of annular forming element 64 to form the second arcuate section 26 of container 10 with a radius R2. An annular bottom surface of punch nose 50 includes two radiused sections 68 and 70 with a flat lower surface 72 therebetween which cooperates with annular forming element 64 and domer 60 to form radiused portions 28 and 32, having radii of R3 and R4 respectively, as well as forming flat lower support portion 30 of container 10. Punch nose 50 also includes a vertical forming wall 74 which cooperates with a vertical wall 76 of domer element 60 to form upwardly-extending flat portion 34 of container 10. Domer element 60 also includes an upper convex surface 78 which forces the bottom end of container 10 upwardly to form domed portion 18 with radius R6, while an annular radius section 80 on domer 60 forms radiused section 36 of container 10 with a radius of R5.

In order to allow for a free flow of metal during the formation of flat annular wall 30, a small gap 82 is produced between the peripheral vertical wall 76 of domer element 60 and the inner vertical wall 74 of the punch nose 50. This small radial gap is on the order of 0.5 mm (0.020 inches) so that the metal can readily be reformed around the upper surface 78 of domer element 60, as well as around the peripheral radiused portion 80 of domer element 60.

As indicated above, one of the problems encountered in forming container shells from reduced thickness of aluminum stock material and reforming the end wall to the configuration described above is that the metal has a tendency to wrinkle, particularly in the reformed juncture area 16, which renders the finished container unacceptable. According to the present invention, the domer 60 and annular forming element 64 are biased with unique biasing means that produce greater pressure in a confined space to insure that the container shell is accurately reformed around the punch 48 without wrinkling of the very ductile aluminum.

Figure 3:
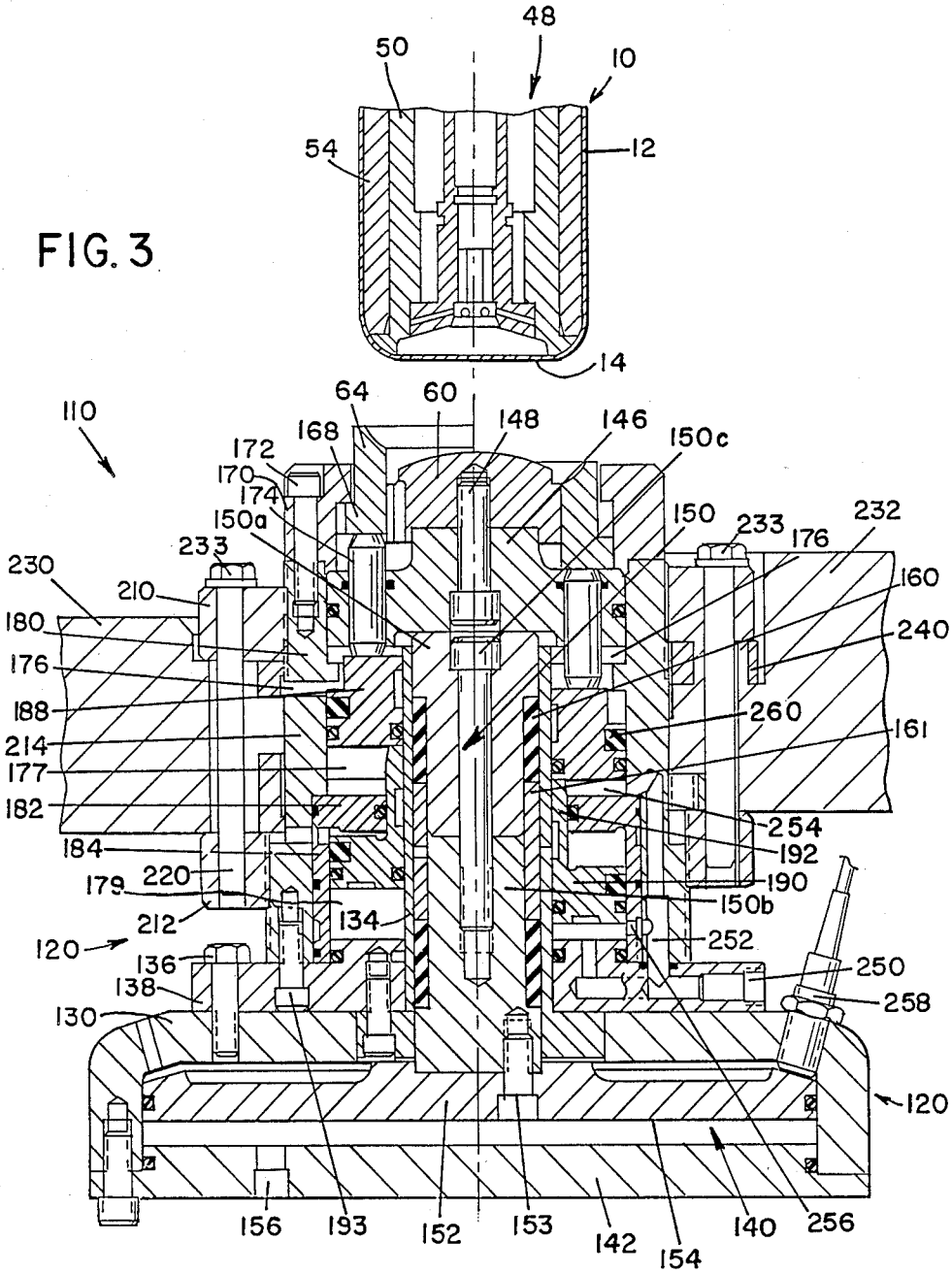

FIG. 3 discloses a domer assembly, constructed in accordance with the teachings of the present invention, generally designated by reference numeral 110 that cooperates with punch 48 for reforming the end wall 14 of drawn and ironing container shell 10 to the configuration described above.

The domer assembly 110 consists of a base or frame structure 120 that has a central domer 60 and an annular forming or doming element 64 surrounding the central domer or pad 60. The center axes of the domer pad 60 and the annular forming element 64 are coaxial with each other and with the axis of the punch or ram 48. The base or frame 120 consists of a generally circular housing 130 at the lower end which has a tubular or circular support column 134 extending therefrom which is held in a fixed position with respect to the lower housing 130 through a plurality of bolts 136 and an annular collar 138. A generally circular chamber 140 is defined on the lower end of the housing 130 and is closed by a lower cover plate 142 to define a sealed chamber that is in communication with the center support column 134.

The center domer element 60 is supported by a domer pad support element 146, with the pad secured to the element 146 through a center screw 148. The support element 146 rests on a center post 150 that extends through the tubular column 134 and has an enlarged pad 152, which is located within the sealed chamber 140, and is secured to the lower end of post 150 by a bolt 153. The pad 152 defines an enlarged continuous surface 154 which is substantially greater than the exposed surface area of domer 60 and is exposed within the chamber 140 to a pressurized pneumatic source of fluid that is delivered into the chamber through an opening 156 in the cover plate.

The center support post 150 is preferably in the form of two members **150*a* and 150*b*, which are interconnected with each other through a bolt 150*c*, with a plurality of anti-friction elements 160, such as brass bushings, supported on reduced portions at the opposite ends of members 150*a* and 150*b* and separated by a spacer 161 to provide a friction-free movement of the post 150 with respect to the tubular support column 134**.

The annular forming element 64 has a peripheral flange 168 and is retained on the upper end of a circular housing 180 through a support collar 170 and a plurality of circumferentially-spaced bolts 172. The lower end of the annular-forming element 64 rests on the upper end of a plurality of circumferentially-spaced pins 174 that extend through openings in the element 146. The lower ends of the pins 174 are exposed within an annular chamber 176 that is defined between the outer circular housing 180 and the center tubular column 134. The annular chamber 176 is divided into first and second chamber segments 177 and 179 through an annular ring 182 that has an outer peripheral flange 184 directed towards collar 138.

Thus, the upper chamber segment 177 is separated from a lower chamber segment 179 through the annular ring 182 and first and second pistons 188 and 190 are respectively located within the upper and lower annular chamber segments 177 and 179. The second annular piston 190 has an upwardly-directed flange 192 integral therewith, the free end of which is adapted to be maintained in engagement with the lower surface of the first piston 188.

In the specific embodiment illustrated, the circular housing 180 has its lower end attached to annular collar 138 through bolts 193 and its upper end attached to support collar 170 through bolts 172 so that the circular housing 180, collar 138 and lower housing 130 define a one-piece or basic frame 120.

This one-piece fixed frame 120 is designed to be received into a confined space in either a Ragsdale bodymaker or a Standun bodymaker without any modification thereof. For this purpose, an upper annular support collar 210 and a lower annular support collar 212 are threaded and received onto the threaded outer surface of circular housing 180. Collars 210 and 212 are utilized in supporting the entire dome assembly 110 in either a frame element 230 that forms part of a commercially-available Ragsdale drawing and ironing machine or a commercially-available Standun machine having a frame element 232.

If the domer assembly is used with a Ragsdale bodymaker, the enlarged collars 210 and 212 abut opposed surfaces of frame element 230 and are clamped with one or more bolts 233 to hold the assembly in the fixed position with respect to the punch assembly 48. If the unit is designed to be utilized with a Standun machine, a spacer sleeve 240 is utilized as part of the support member, along with collars 210 and 212 to fix the domer assembly on frame element 232 using a bolt 233.

Pressurized pneumatic fluid is supplied to the chamber 176 through conduit means that may be formed directly in the one-piece fixed frame and connected to a pressurized pneumatic fluid source or means, such as air (not shown). Thus, as shown in FIG. 3, collar 138 has one or more counterbores 250 extending from the periphery thereof and in communication with an axial bore 252 in circular housing 180 which in turn is in communication with chamber segments 177 and 179 through bores 254 and 256, respectively. The source (not shown) is connected to the open end of counterbore 250 and may have an accumulator (not shown) associated therewith. The same or a different pressurized fluid source is connected to inlet 156. Suitable seals 260 are provided where necessary.

The provision of two axially-spaced pistons in the separate chambers, which may be considered primary and secondary biasing means, both in communication with a pressurized fluid source, produces greater holding pressures between the annular element 64 and the punch 48 during the forming process in a very confined space, which minimizes the possibility of wrinkles developing in the reformed end wall of the container shell. Also, as can be seen from the drawing, the surface area of the pad 152 is extremely large in relation to the surface area of the domer pad so that extremely large reaction forces can be absorbed with significant movement of the domer element and, at the same time, the domer element can still move a limited amount without destruction of the tooling in case a misfed container shell is introduced into the system.

If desired, a sensor 258 may be provided to sense the extent of movement of pad 152 and interrupt the machine in the event of excessive movement of the domer 60, such as when two container shells are on punch 48 simultaneously. Also, vent openings 270 may be provided through circular housing 180 to vent the unpressurized side of chamber segments 177 and 179 to atmosphere.

A further advantage of the above arrangement of the domer assembly is that the domer 60 and/or annular forming element 64 can easily be replaced merely by removal of bolts 172 and collar 170. After the collar 170 is removed, the domer 60 and/or annular forming element can be withdrawn and replaced.

As is apparent from an inspection of FIG. 3, the internal opening in circular housing 180 is stepped to provide a shoulder 272 for ring 182 resulting in different volumes for chamber segments 177 and 179 and different surface areas on pistons 188 and 190 exposed to the pressurized fluid. Thus, chamber segments 177 and 179 could be pressurized to different levels to initially provide a lower holding force in annular forming element which would be increased as the forming element moves.

We claim:

1. Apparatus for reforming an end wall of a container shell comprising a punch reciprocable along a path with said container shell thereon, a base at the end of said path having a center tubular column having a center post telescoped therein with a central domer supported on said post and aligned with said punch, an enlarged reaction pad on an opposite end of said post and located in a sealed chamber on said base with pressurized fluid in said chamber to bias said central domer toward said punch, and an annular forming element surrounding said central domer with biasing means between said base and said annular forming element, said biasing means including first and second axially-spaced annular pistons around said column and engageable with said annular forming element and pressurized penumatic fluid means in communication with said first and second pistons to bias said annular forming element to a first position and accommodate constrained movement of said annular forming element in response to forces applied by said punch.

2. Apparatus as defined in claim 1, in which said base has an annular chamber surrounding said column with a divider in said chamber to form first and second chamber segments respectively having said first and second pistons therein and said pressurized pneumatic fluid means is in communication with both chamber segments so that a large reaction force is developed on said annular forming element in a confined annular space.

3. Apparatus as defined in claim 2, in which said first piston has a first surface engageable with said annular forming element and an opposite surface exposed to said pressurized pneumatic fluid means and in which said second piston has an annular flange extending from a first surface engageable with said opposite surface and an opposite surface exposed to said pressurized pneumatic fluid means.

4. Apparatus as defined in claim 1, in which said punch has an annular nose having an outer arcuate annular portion, a lower flat portion extending substantially perpendicular to said path and an inner annular wall extending substantially parallel to said path; and in which said annular forming element has an inner arcuate surface exposed to said outer arcuate annular surface of said punch to reform a peripheral portion of said container shell to an annular arcuate portion; and in which said central domer has a center exposed radiused portion surrounded by a generally flat vertical parallel wall extending perpendicular to said path and an outwardly-extending horizontal wall defining a ledge and cooperating with said inner annular wall and said lower flat portion of said punch respectively to produce a lower flat annular wall on said container shell inwardly of said annular arcuate portion and a substantially vertical annular portion at an inner end of said lower flat wall which surrounds a center upwardly-directed dome.

5. Apparatus for forming a generally flat end wall of a container shell of aluminum stock material having a thickness of 0.0130 inches or less capable of resisting internal pressures and buckle pressures in excess of 100 psi comprising a circular punch movable along a path and having a domer assembly including a frame and a center domer pad surrounded by an annular forming element at the end of said path, the improvement of said punch having a cylindrical peripheral surface conforming to the interior of said shell and having a peripheral nose on a free end, said nose having a first outer annular flat portion defining a small acute angle of less than five degrees with respect to said peripheral surface and a first annular arcuate portion at the lower end of said first outer annular flat portion merging with a lower flat horizontal portion extending substantially perpendicular to said path and terminating in an inner substantially flat vertical annular wall, said annular forming element having an inner annular arcuate forming surface confronting said first annular arcuate portion of said punch, and said center domer pad having a central arcuate convex surface surrounded by a radiused portion merging with an annular flat vertical wall that has an outwardly-extending ledge around the perimeter thereof, and biasing means between said frame, center domer pad and annular forming element, said biasing means including a center post aligned with said center domer pad and having an enlarged pressure pad at one end with said frame having a sealed chamber receiving said pressure pad, first and second annular pistons surrounding said center post with said frame having an annular chamber receiving said first and second annular pistons, and pressurized pneumatic fluid means in communication with said sealed chamber and said said annular chamber so that said end wall of said container shell is initially formed around said central arcuate convex surface while a peripheral portion is held beteen said inner annular arcuate portion of said annular forming element and said first annular arcuate portion of said punch and continued movement of said punch produces a substantially vertical annular portion between said flat annular vertical wall of said punch and said annular flat vertical wall of said domer pad and a substantially flat horizontal annular support between said ledge of said center domer pad and said lower flat horizontal portion of said punch.

6. Apparatus for reforming an end wall of a container comprising a punch reciprocable along a path, a fixed base at an end of said path and having a tubular column generally aligned with said path, a domer pad supported on a post extending through said column with said post having an enlarged surface on an opposite end thereof and said base having an enlarged sealed chamber surrounding said enlarged surface, means providing pressurized pneumatic fluid to said chamber to produce a reaction force on said surface and allow said domer to partially retract at the end of a stroke of said punch to insure conformity of said end wall with the configuration of said domer pad and said punch, an annular forming element surrounding said domer pad and positioned to be at the end of said path of said punch, and biasing means between said base and said forming element normally maintaining said forming element in a first position, said biasing means including first and second annular pistons surrounding said tubular post with said base having an annular chamber surrounding said post and receiving said pistons and pressurized pneumatic means communicating with said annular chamber, accomodating movement from said first position by forces applied by said punch to said annular forming element to insure conformity of said end wall with said forming element and said punch.

7. Apparatus as defined in claim 6, in which said first annular piston is positioned to be engageable with said annular forming element and said second annular piston is axially spaced along said post and has an annular flange extending toward and engageable with said first annular piston.

8. Apparatus as defined in claim 7, in which said annular chamber has a divider forming first and second chamber segments with said first and second pistons respectively located in said first and second chamber segments and in which said second piston has a greater surface area than said first piston exposed to said pressurized pneumatic means to produce a greater force on said annular forming element.

9. Apparatus for forming a dome on an end wall of a container comprising a punch reciprocable along a path and having a free end corresponding at least in part to an ultimate configuration for said end wall, a base aligned with said path and said punch and having a center column extending toward said punch with a center post having a central domer pad thereon aligned with said punch, biasing means acting on said center post, and an annular forming element surrounding said central domer and movable on said base, the improvement of primary and secondary means between said base and said annular forming element providing controlled movement of said annular forming element on said base during final movement of said punch along said path to insure that said end wall conforms to the end configuration of said central domer and said annular forming element.

10. Apparatus as defined in claim 9, in which said primary means includes a first annular piston and said secondary means includes a second annular piston with an annular chamber in said base receiving said pistons.

11. Apparatus as defined in claim 10, in which said annular chamber has first and second chamber segments with said first and second pistons respectively received in said chamber segments and common pressurized pneumatic means in communication with said chamber segments.

* * * * *

UNITED STATES PATENT AND TRADEMARK OFFICE

CERTIFICATE OF CORRECTION

PATENT NO. : 4,620,434

DATED : November 4, 1986

INVENTOR(S) : Sam C. Pulciani, Raymond Mikas, Robert M. Wyleta

It is certified that error appears in the above-identified patent and that said Letters Patent are hereby corrected as shown below:

The correct spelling of the first-named Inventor is --Sam C. Pulciani--.

Column 3, line 28, after "of" insert --the--; line 58, after "striving" delete "the" and insert --to--.

Column 5, line 5, after "is" insert --a--; line 5, delete "views" and insert --view--.

Column 6, line 39, after "annular" delete "flat".

Column 9, line 2, after "with" insert --a--; line 4, after "radius" delete "of".

Signed and Sealed this

Third Day of February, 1987

*Attest:*

DONALD J. QUIGG

*Attesting Officer*

*Commissioner of Patents and Trademarks*